US009084474B2

(12) United States Patent
DePaola, Jr. et al.

(10) Patent No.: US 9,084,474 B2
(45) Date of Patent: Jul. 21, 2015

(54) PAINT BRUSH STORAGE AND PROTECTION DEVICE

(71) Applicant: Likwid Concepts L.L.C., Jackson, NJ (US)

(72) Inventors: Salvatore DePaola, Jr., Staten Island, NY (US); John Anthony DePaola, Jackson, NJ (US)

(73) Assignee: Likwid Concepts L.L.C., Jackson, NJ (US)

( * ) Notice: Subject to any disclaimer, the term of this patent is extended or adjusted under 35 U.S.C. 154(b) by 0 days.

(21) Appl. No.: 13/870,234

(22) Filed: Apr. 25, 2013

(65) Prior Publication Data

US 2013/0299362 A1 Nov. 14, 2013

Related U.S. Application Data

(60) Provisional application No. 61/638,017, filed on Apr. 25, 2012.

(51) Int. Cl.

| | |
|---|---|
| ***B05C 17/00*** | (2006.01) |
| ***A46B 17/04*** | (2006.01) |
| ***B44D 3/12*** | (2006.01) |

(52) U.S. Cl.

CPC ..... *A46B 17/04* (2013.01); *B44D 3/123* (2013.01); *B44D 3/125* (2013.01)

(58) Field of Classification Search

CPC ..... B44D 3/123; B44D 3/125
USPC ..... 206/361, 1.7, 362.2, 362.3, 15.2, 15.3
See application file for complete search history.

(56) References Cited

U.S. PATENT DOCUMENTS

| | | | | |
|---|---|---|---|---|
| 1,851,521 | A | 3/1932 | Olsen | |
| 1,869,753 | A | 8/1932 | Kamm | |
| 2,485,068 | A | 10/1949 | Santana | |
| 4,423,811 | A | 1/1984 | Knapp | |
| 4,767,655 | A * | 8/1988 | Tschudin-Mahrer | 428/57 |
| 5,174,445 | A | 12/1992 | Mull | |
| 5,540,363 | A | 7/1996 | Wilson | |
| 5,645,167 | A | 7/1997 | Conrad | |
| D401,765 | S | 12/1998 | Soutullo | |
| 6,390,430 | B1 * | 5/2002 | Hawley et al. | 248/311.2 |
| D491,730 | S * | 6/2004 | Goulet et al. | D4/199 |
| D503,282 | S | 3/2005 | Murphy | |
| D511,412 | S | 11/2005 | Madrid et al. | |
| 7,207,437 | B1 | 4/2007 | Johansson | |

(Continued)

OTHER PUBLICATIONS

International Search Report dated Aug. 9, 2013.

*Primary Examiner* — Anthony Stashick
*Assistant Examiner* — James Way
(74) *Attorney, Agent, or Firm* — Charney IP Law LLC

(57) ABSTRACT

A paint brush storage and protection device includes an open well having an upstanding wall ending in an upper wall, the wall being continuous from one side of an opening to another; a top with an open channel extending around the perimeter of the top except at and end of an extension area; a hinge connecting the open well to the top; a seal located in the opening; a first latching mechanism associated with the open well and top opposite the hinge; and a second latching mechanism associated with the open well and top in the area of the opening. A paint brush may be placed within the well and the top closed over the well by deflection of the hinge so the upper wall forms a generally airtight connection with the open channel and the seal closes the opening to secure and protect a paint brush.

15 Claims, 9 Drawing Sheets

(56) References Cited

U.S. PATENT DOCUMENTS

| | | | | |
|---|---|---|---|---|
| 7,401,614 | B2 * | 7/2008 | Ruzumna | 134/135 |
| 7,537,111 | B2 | 5/2009 | Hart et al. | |
| D623,862 | S | 9/2010 | Nitzsche | |
| 7,927,430 | B2 | 4/2011 | Hart et al. | |
| 7,987,980 | B1 | 8/2011 | Hahn | |
| 8,074,796 | B1 | 12/2011 | Andrews | |
| 2002/0157978 | A1 * | 10/2002 | Roundy | 206/361 |
| 2004/0050732 | A1 | 3/2004 | Baker | |
| 2005/0247030 | A1 * | 11/2005 | Phillips et al. | 53/397 |

* cited by examiner

PAINT BRUSH STORAGE AND PROTECTION DEVICE

CROSS-REFERENCE TO RELATED APPLICATIONS

The present application claims the benefit of U.S. Provisional Application Ser. No. 61/638,017 entitled "Paint Brush Storage and Protection Device" filed Apr. 25, 2012, the disclosure of which is hereby incorporated by reference herein.

BACKGROUND OF THE INVENTION

Anyone who has painted, either professionally or as a do-it-yourselfer, knows that storage and protection of paint brushes is a major concern and warrants a great deal of attention. The present invention relates to the storage and protection of paint brushes, both new and used, when not in use, including paint brushes that have been used and are still covered with paint.

Storage and protection of paint brushes is particularly paramount in the case of used wet brushes. Often, painters must cease working without completing a particular task. This may be for an extended break or at the end of the work day. Conventionally the painter would have to clean the brush in copious amounts of water and then store the brush to dry. The use of so much water and the washing of paint down the drain presents obvious environmental issues. Moreover, storage and protection of the wet brush is problematic because one needs to ensure that it does not drip needlessly while also protecting the delicate bristles and metal ferrule. Because of simple laziness, some painters will discard a used brush instead of cleaning it. This presents both economic issues for the painter as well as environmental issues.

Even for new brushes protection is important. Brushes contain delicate bristles that may be bent, pulled out, or otherwise compromised in storage and transport.

It would therefore be highly beneficial to provide a novel and effective manner of storing and protecting paint brushes, both new and used, when not in use.

BRIEF SUMMARY OF THE INVENTION

The present invention provides this benefit by providing, in one embodiment, a paint brush storage and protection device with a base having an exterior upstanding wall ending in a shoulder, the exterior wall being discontinuous in an open stem area; a top surrounded by a U-shaped channel, the U-shaped channel being discontinuous in the open stem area; a living hinge connecting the base and the top; a first latching mechanism comprising a cantilevered tab extending from the U-shaped channel of the top, the cantilevered tab including a hook adapted to engage the shoulder of the base when the paint brush storage and protection device is closed; and a second latching mechanism comprising a pair of cantilevered tabs extending from the U-shaped channel of the top, the pair of cantilevered tabs each including a hook adapted to engage the shoulder of the base when the paint brush storage and protection device is closed. The paint brush storage and protection device may be closed by deflecting the living hinge and fitting the U-shaped channel over the shoulder of the base thereby forming an airtight seal. The paint brush storage and protection device further comprises a sealing member at the open stem area and at least one projection extending from the base toward the top when the paint brush storage and protection device is in a closed condition, the at least one projection adapted to engage a paint brush.

The paint brush storage and protection device may further comprise a magnet.

The magnet may be positioned on an exterior surface of the paint brush storage and protection device.

In accordance with a further embodiment, a paint brush storage and protection device includes an open well having an upstanding wall ending in an upper wall, the upstanding wall being continuous from one side of an opening to another; a top with an open channel, the open channel extending around the perimeter of the top except at and end of an extension area; a hinge connecting the open well to the top; a seal located in the opening; a first latching mechanism associated with the open well and top opposite the hinge; and a second latching mechanism associated with the open well and top in the area of the opening. A paint brush may be placed within the well and the top may be closed over the well by deflection of the hinge such that the upper wall forms a generally airtight connection with the open channel and the seal closes the opening to secure and protect a paint brush, the first and second latching mechanisms serving to secure the top to the open well.

The paint brush storage and protection device may further comprise a magnet. The magnet may be positioned on an exterior surface of the paint brush storage and protection device.

The paint brush storage and protection device may further comprise at least one projection extending from within the open well generally parallel to the upstanding wall, the projection adapted to engage a paint brush when placed in the open well. The at least one projection may be a linear projection. The at least one projection may be geometrically shaped or non-geometrically shaped.

The device may be generally translucent.

The second latching mechanism may comprise a pair of cantilevered tabs extending from the open channel of the top, the pair of tabs each including a hook adapted to engage the upstanding wall upper end when the paint brush storage and protection device is closed. The first latching mechanism may comprise a cantilevered tab extending from the open channel of the top, the cantilevered tab including a hook adapted to engage the upstanding wall upper end when the paint brush storage and protection device is closed. The seal may be open cell foam.

In a further embodiment, a method of protecting and storing a paint brush in a paint brush storage and protection device is provided, where the paint brush storage and protection device has a base forming a well; a top; first, second, and third locking mechanisms to secure the top against the base in an airtight manner; and an open stem area with a seal; the method comprises placing a paint brush in the well of the base of the paint brush storage and protection device; closing the top of the paint brush storage and protection device to enclose at least the bristles of the brush; securing the first locking mechanism; securing the second locking mechanism; securing the third locking mechanism; whereby the steps of closing and securing deform the seal around the stem of the paint brush.

The paint brush storage and protection device may further comprise a projection on an interior thereof, the method therefore further comprising placing the bristles of the paint brush against the projection.

Inventive devices are particularly useful for protecting the bristles of a paint brush, whether wet or dry, and for storing a wet paint brush in an air-tight enclosure for preservation during painting projects.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof, will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

With respect to the drawings.

DETAILED DESCRIPTION

Figure 1:
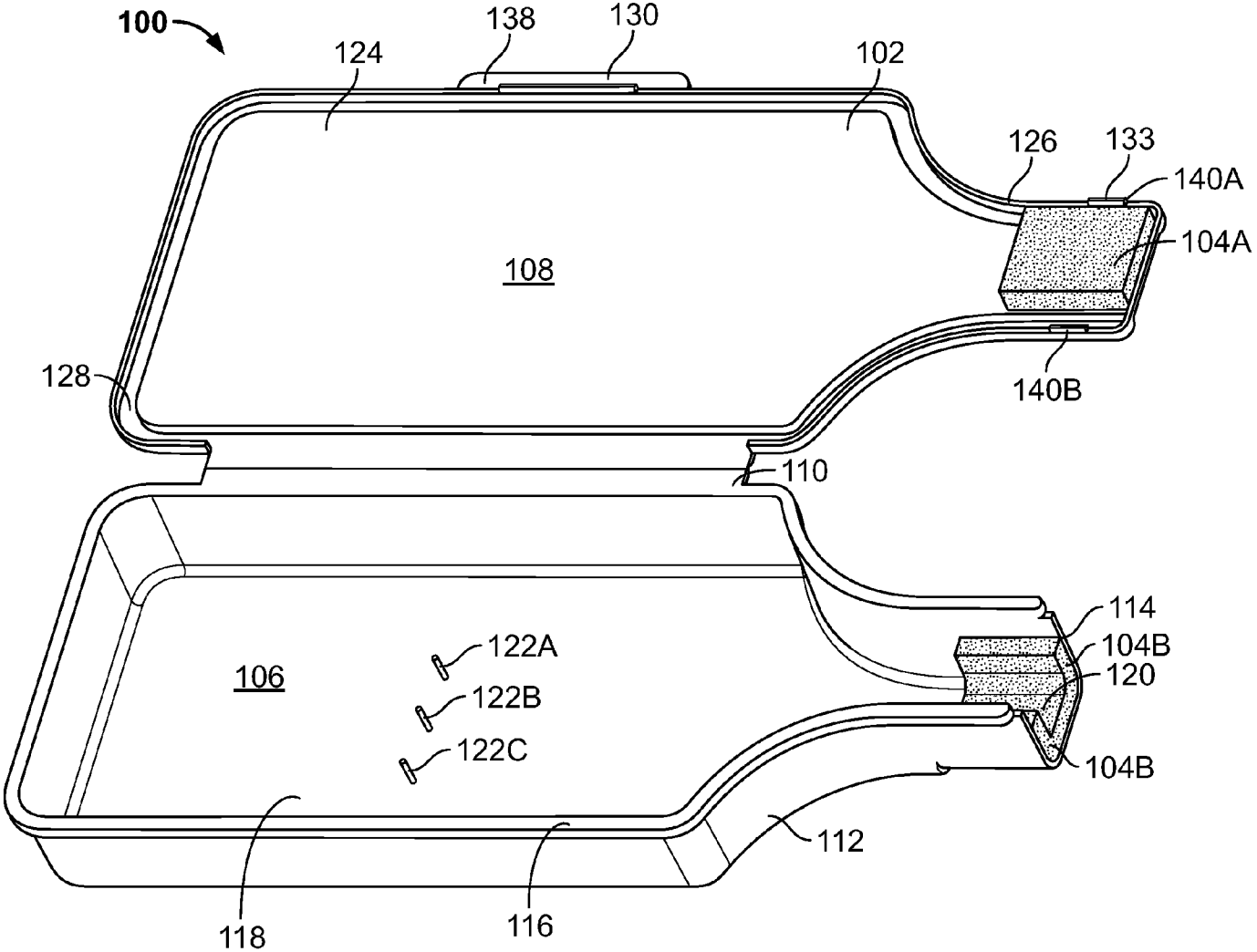
FIG. 1 is an isometric view of a paint brush storage and protection device in a fully open condition.

In the following are described the preferred embodiments of the vertically expandable receptacle of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

As shown in the numbered drawing figures, and beginning with FIG. 1, in one embodiment a paint brush storage and protection device 100 is comprised of an enclosure 102 and a two part seal consisting of a flat seal 104A and a U-seal 104B. The enclosure comprises a base 106 and a top 108 connected by hinge 110. Preferably the hinge 110 is a living hinge formed from the same material as the remainder of the enclosure 102.

The base 106 includes an upstanding wall 112 which is continuous from an open stem area 114, around the perimeter of the base, and back to the open stem area. The upstanding wall 112 forms a shoulder 116 at the upper wall area thereof. As will be seen in further views, the shoulder 116 at the upper wall is formed as a built up area of material which serves to provide rigidity to the upstanding wall 112 as well as forming a portion of an airtight seal with other components of the enclosure 102.

Figure 12:
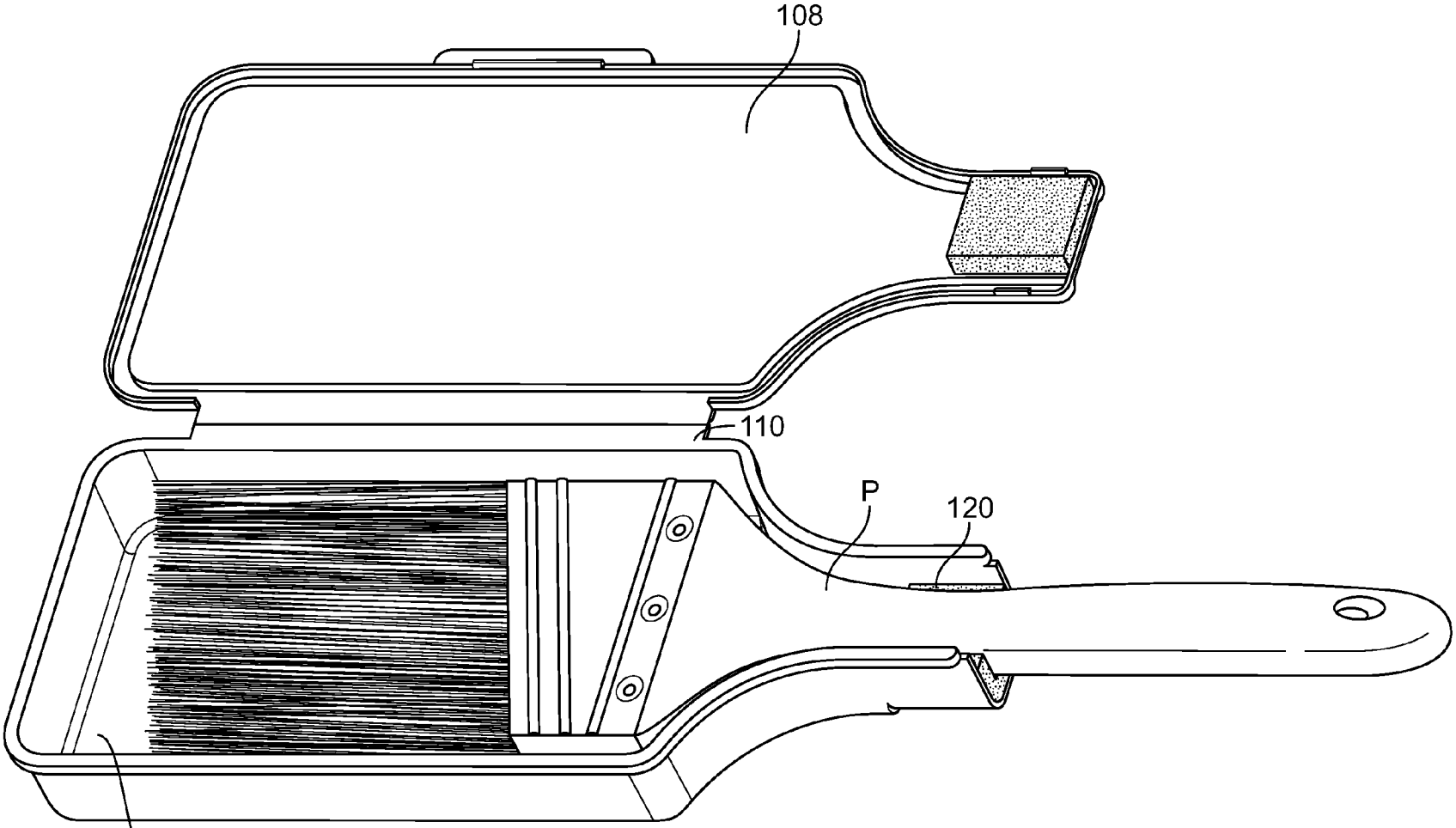
FIG. 12 is an isometric view of a paint brush placed within the paint brush storage and protection device of FIG. 1 in the open condition.

It will be appreciated that the base 106 is shaped to accommodate a standard paintbrush and includes a large main area 118 that tapers to an opening 120 in the open stem area 114. Thus, the body and bristles of a paintbrush may be laid within the main area 118 while the handle of the paintbrush extends out of the opening 120 in the open stem area 114. A paint brush P in such a configuration is shown in FIG. 12. The combination of the main area 118 and open stem area 114 may be referred to as a well for receiving a paintbrush, the well being formed by the upstanding wall 112.

Also provided in the main area 118 are a series of raised projections 122A, 122B, 122C. In the embodiment shown there are three such projections, however a greater or lesser number may also be provided. Also, in the embodiment shown the projections 122A, 122B, 122C are generally cylindrical. In other embodiments the projections may take on other geometric or non-geometric shapes. The projections 122A, 122B, 122C serve to cooperate with the paint brush, preferably in the bristle area just adjacent to the metal binding, to hold the paint brush securely within the base 106.

As discussed, there is located a U-shaped seal 104B in the open stem area 114 of the base 106. The U-shaped seal 104B is typically configured from open cell foam but may also be configured from closed cell foam, rubber, or other resilient materials. The principal function of the U-shaped seal 104B is to cooperate with the flat seal 104A to provide an airtight seal around the handle of a paintbrush when the paint brush storage and protection device is in a closed condition. The seal also helps to ensure that the paint brush does not shift within the enclosure 102 by fitting snugly around the handle of the paint brush.

The remainder of the enclosure 102, including the base 106, top 108, and hinge 110, are preferably formed as a unitary component from various plastics such as polyethylene. Most preferably, the material is transparent or translucent such that the within paintbrush can be viewed. In the situation where multiple paint brush storage and protection devices are utilized by a user, transparent or translucent cases permit the user to view the color of paint on the stored paint brush.

The top 108 is generally planar with a main area 124 tapering to a stem area 126. It is at the stem area 126 where the flat seal 104A is located. Appreciably, the main area 124 of the top 108 corresponds to the main area 118 of the base 106 while the stem area 126 of the top corresponds to the open stem area 114 of the base. The stem area 126 of the top 108 may also be referred to as an extension area.

Figure 10:
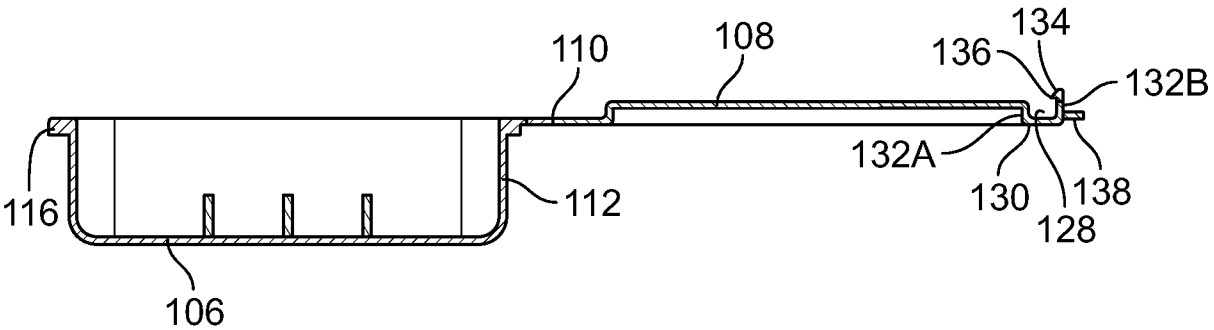
FIG. 10 is a cross-sectional view of the paint brush storage and protection device of FIG. 1 in the fully open condition.
Figure 11:
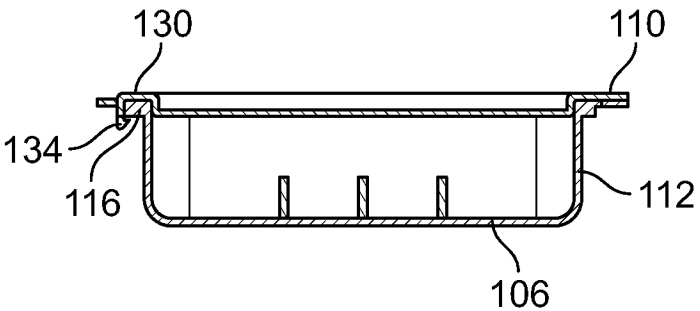
FIG. 11 is a cross-sectional view of the paint brush storage and protection device of FIG. 1 in the fully closed condition.

Around the perimeter of the top 108 is formed a U-shaped channel or open channel 128. The U-shaped channel 128 is most clearly shown in FIG. 10 where one will appreciate that the U-shaped channel includes a bridge section 130 between two walls 132A, 132B. As shown in FIG. 11, when the paint brush storage and protection device 100 is in a closed condition, the U-shaped channel 128 fits snugly over the shoulder 116 of the upstanding wall 112. This arrangement provides an airtight seal between the two components.

In order to aid in the closure process, the paint brush storage and protection device 100 includes latching means. In the embodiment shown, the latching means come in two forms, a first latching mechanism 130 and a second latching mechanism 133. The first latching mechanism 130 comprises a cantilevered tab 134 extending from the U-shaped channel 128 of the top 108. As shown in FIG. 10, the cantilevered tab 134 extends from a portion of wall 132B and culminates in a hook 136 that is shaped and configured to clasp the underside of the shoulder 116 as shown in FIG. 11 when the paint brush storage and protection device 100 is closed. For ease in opening and closing the first latching mechanism 130, the mechanism is provided with a handle 138. As shown in the figures, the first latching mechanism 130 is preferably associated with the main area 124 of the top 108.

Figure 9:
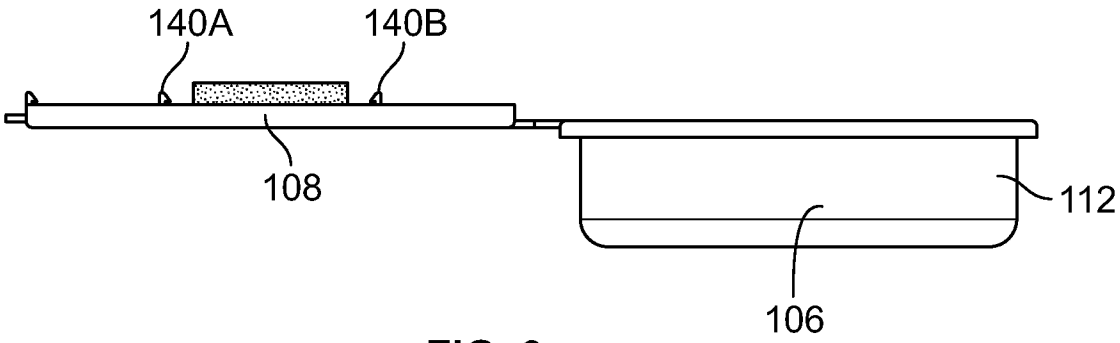
FIG. 9 is a rear view of the paint brush storage and protection device of FIG. 1 in the fully open condition.

The second latching mechanism 133 comprises a pair of cantilevered tabs 140A, 140B, best shown in FIG. 9 (it will be appreciated that the cantilevered tabs 140A, 140B may also be referred to separately as second and third latching mechanisms). The cantilevered tabs 140A, 140B operate in a manner similar to that of cantilevered tab 134 and include a hook section that clasps with the underside of shoulder 116. The second latching mechanism 133 is preferably located on either side of the stem area of the top 108 and aid in compressing the flat seal 104A and U-shaped seal 104B against the handle of a paintbrush when the paint brush storage and protection device 100 is closed. In some embodiments, not all of the locking mechanisms need be included.

In order to properly close the paint brush storage and protection device it is preferred that a user begin by latching the first latching mechanism 130 and then separately latch the two parts of the second latching mechanism 133. Thus the top 108 can first be properly positioned over the base 106 before the second latching mechanism 133 is fully secured. Of course, the second latching mechanism 133 can be latched first or simultaneously.

In some embodiments of the paint brush storage and protection device 100, there may be included one or more magnets 142. Preferably, the magnet(s) 142 is located on the backside of the base 106. The magnet(s) 142 may be formed from known ferromagnetic materials such as iron, nickel, cobalt or rare earth metal alloys and are provided so the paint brush storage and protection device 100 may be magnetically attached to a metal object such as a paint can, ladder, or the like.

The paint brush storage and protection device 100 functions to store paint brushes and protect the bristles thereof from fraying. When storing a wet brush, it also aids in lessoning rusting of the metal bristle band encasing the base of the bristles. It may also be utilized as a temporary holding bin for brushes in use. In order to use the device, one simply inserts the bristles and lower portion of the brush handle into the well of the base 106 and closes the top 108 cover. For proper closure, one must provide sufficient force to cause the U-shaped channel 128 to seal against the shoulder 116 and for the latch mechanism 130 to latch. If so provided, the user may also have to separately ensure that the second latch mechanism 133 is secured by squeezing the mechanisms together at the open stem area 114.

Figure 2:
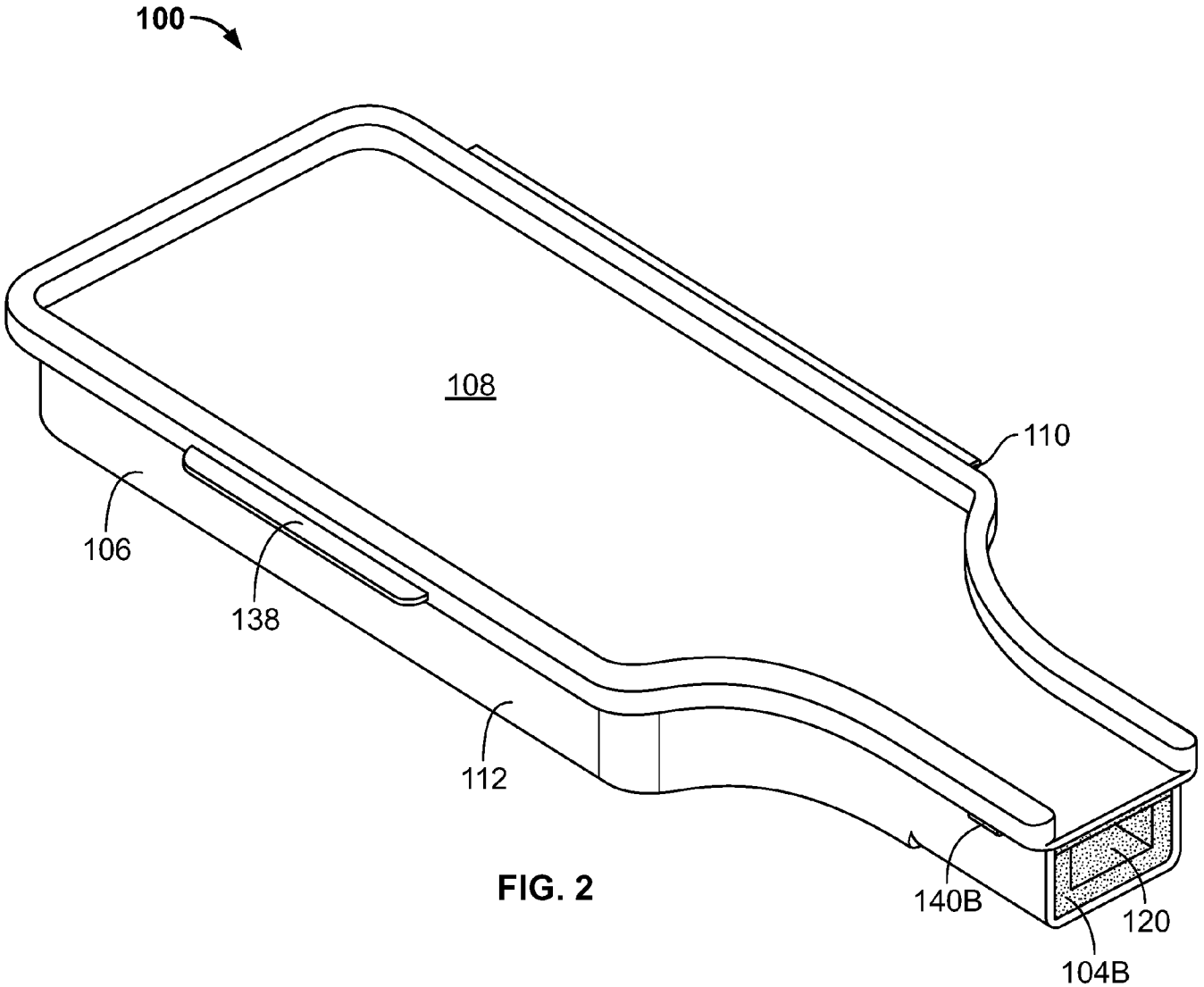
FIG. 2 is an isometric view of the paint brush storage and protection device of FIG. 1 in the fully closed condition.

FIG. 2 depicts an isometric view of the paint brush storage and protection device 100 of FIG. 1 in the fully closed condition. Here, the top 108 is closed over the base 106 with the latching mechanisms 130, 133 fully closed. In the view shown, a paint brush handle would protrude from the opening 120 if a paint brush were in use.

Figure 3:
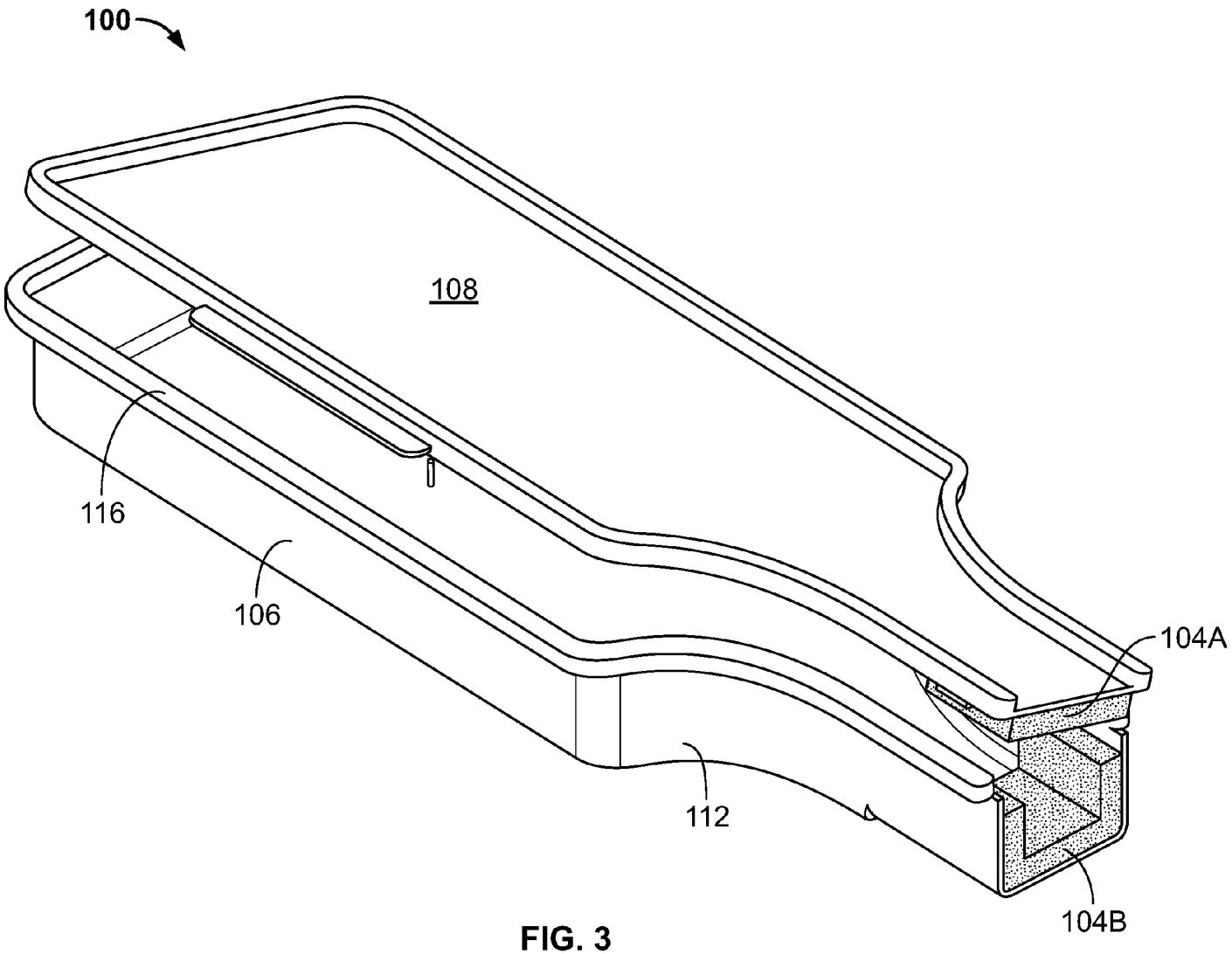
FIG. 3 is an isometric view of the paint brush storage and protection device of FIG. 1 in a partially closed condition.

FIG. 3 is an isometric view of the paint brush storage and protection device 100 of FIG. 1 in a partially closed condition. Notably, the top 108 is ajar from the base 106 and the latching mechanisms 130, 133 are fully open.

Figure 4:
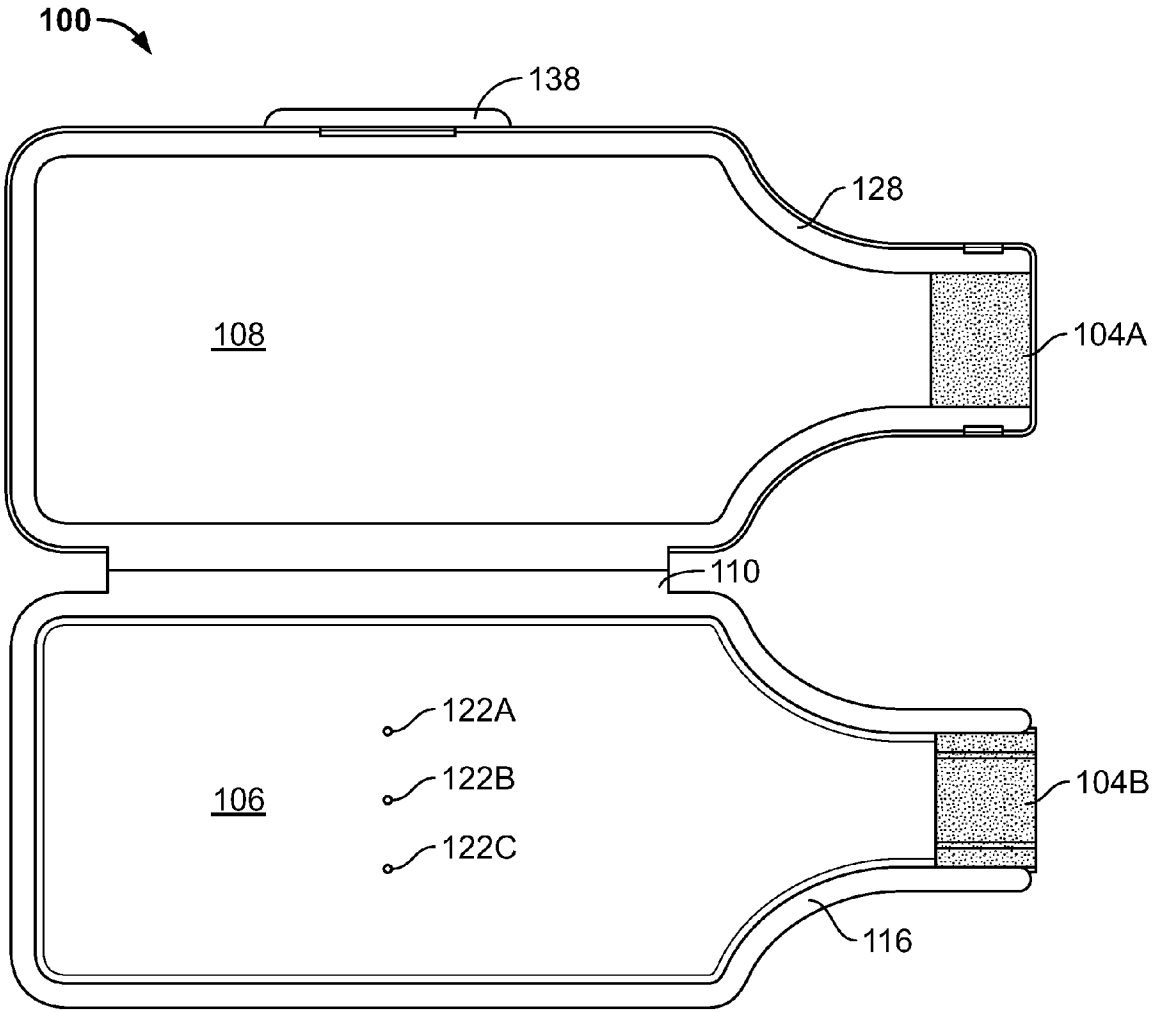
FIG. 4 is a top plan view of the paint brush storage and protection device of FIG. 1 in the fully open condition.

FIG. 4 is a top plan view of the paint brush storage and protection device of FIG. 1 in the fully open condition.

Figure 5:
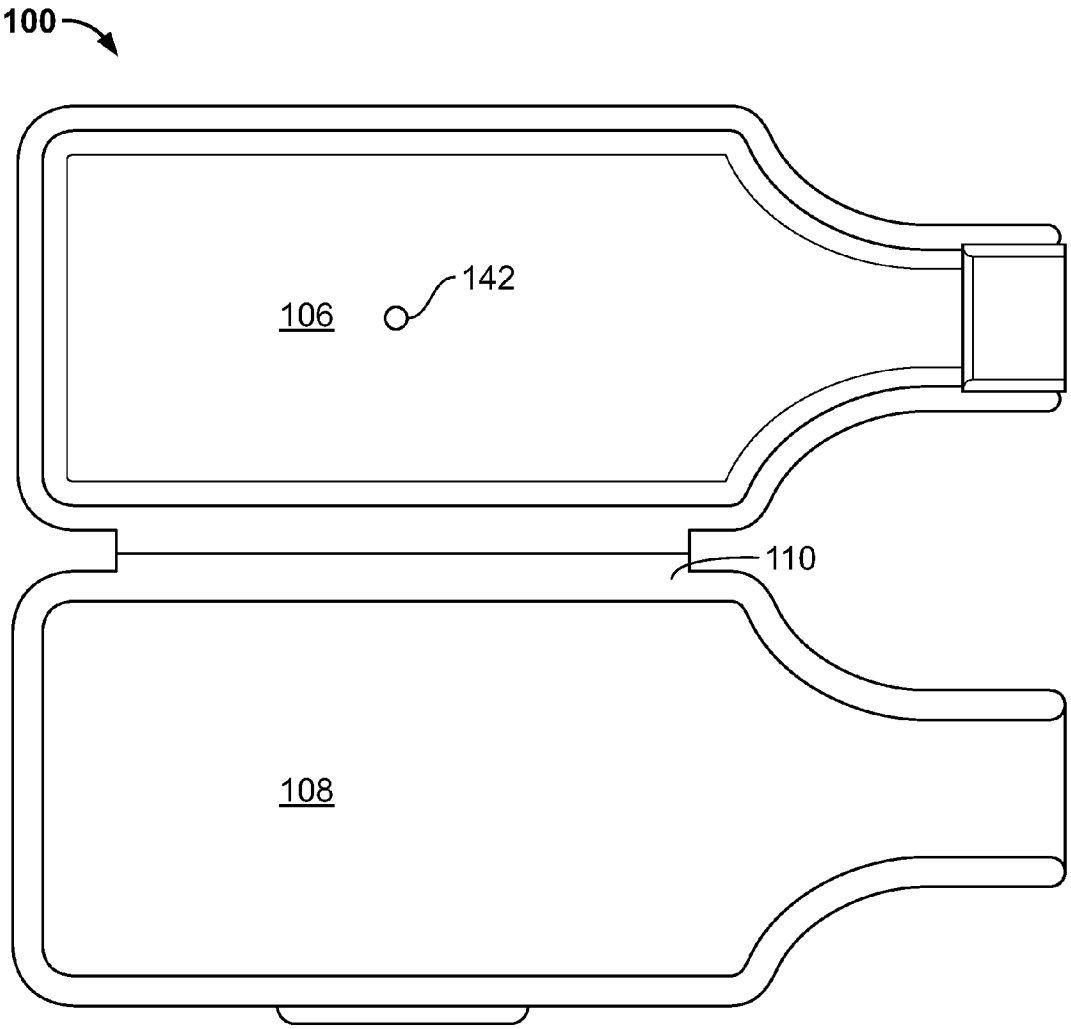
FIG. 5 is a bottom plan view of the paint brush storage and protection device of FIG. 1 in the fully open condition.

FIG. 5 is a bottom plan view of the paint brush storage and protection device of FIG. 1 in the fully open condition. Shown in this view is a magnet 142. Such a magnet is optional and may not be included in all embodiments.

Figure 6:
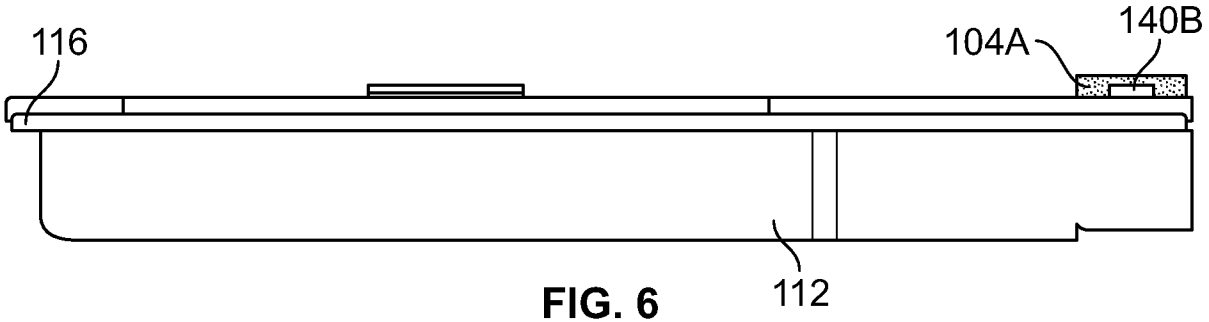
FIG. 6 is a left side view of the paint brush storage and protection device of FIG. 1 in the fully open condition.

FIG. 6 is a left side view of the paint brush storage and protection device of FIG. 1 in the fully open condition.

Figure 7:
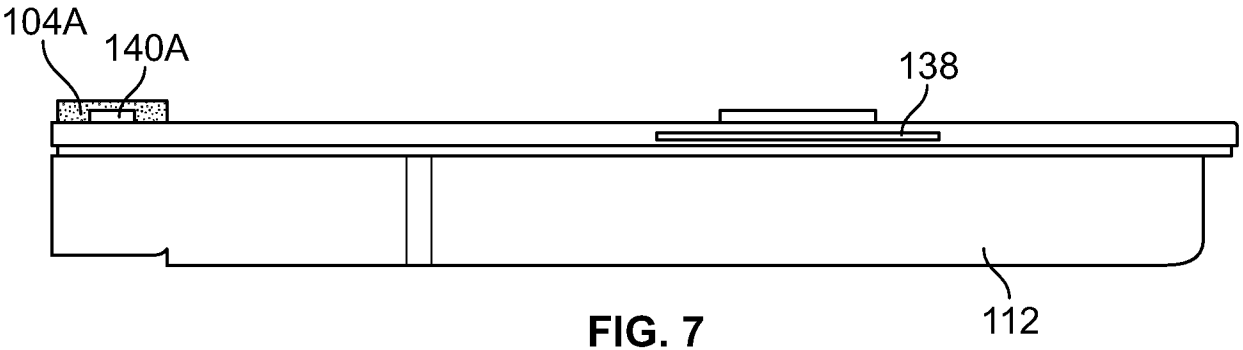
FIG. 7 is a right side view of the paint brush storage and protection device of FIG. 1 in the fully open condition.

FIG. 7 is a right side view of the paint brush storage and protection device of FIG. 1 in the fully open condition.

Figure 8:
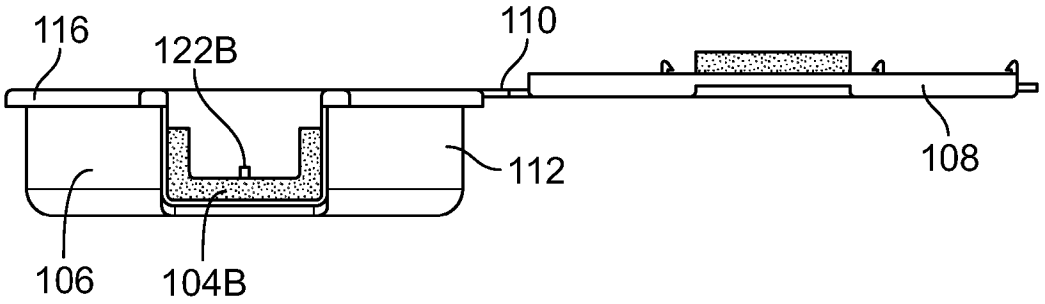
FIG. 8 is a frontal view of the paint brush storage and protection device of FIG. 1 in the fully open condition.

FIG. 8 is a frontal view of the paint brush storage and protection device of FIG. 1 in the fully open condition.

FIG. 9 is a rear view of the paint brush storage and protection device of FIG. 1 in the fully open condition.

FIG. 10 is a cross-sectional view of the paint brush storage and protection device of FIG. 1 in the fully open condition.

FIG. 11 is a cross-sectional view of the paint brush storage and protection device of FIG. 1 in the fully closed condition.

FIG. 12 is an isometric view of a paint brush placed within the paint brush storage and protection device of FIG. 1 in the open condition.

Although the invention herein has been described with reference to particular embodiments, it is to be understood that these embodiments are merely illustrative of the principles and applications of the present invention. It is therefore to understood that numerous modifications may be made to the illustrative embodiments and that other arrangements may be devised without departing from the spirit and scope of the present invention as defined by the appended claims.

The invention claimed is:

1. A paint brush storage and protection device comprising:

a base having an exterior upstanding wall ending in a shoulder, the exterior wall being discontinuous in an open stem area;

a top surrounded by a U-shaped channel, the U-shaped channel being discontinuous in said open stem area such that said U-shaped channel includes parallel portions on opposite sides of said open stem area, said parallel portions being on different planes in their length direction with respect to a longitudinal axis of the device;

a living hinge connecting said base and said top;

a first latching mechanism comprising a cantilevered tab extending from said U-shaped channel of said top, said cantilevered tab including a hook adapted to engage said shoulder of said base when said paint brush storage and protection device is closed;

a second latching mechanism comprising a pair of cantilevered tabs extending from said U-shaped channel of said top, said pair of cantilevered tabs each located on opposite sides of said parallel portions and including a hook adapted to engage said shoulder of said base when said paint brush storage and protection device is closed;

wherein said paint brush storage and protection device may be closed by deflecting said living hinge and fitting said U-shaped channel over said shoulder of said base thereby forming an airtight seal;

said paint brush storage and protection device further comprising a sealing member at said open stem area.

2. The paint brush storage and protection device as claimed in claim 1, further comprising a magnet.

3. The paint brush storage and protection device as claimed in claim 2, wherein said magnet is positioned on an exterior surface of said paint brush storage and protection device.

4. The paint brush storage and protection device of claim 1, further comprising at least one projection extending from said base toward said top when said paint brush storage and protection device is in a closed condition, said at least one projection adapted to engage a paint brush.

5. A paint brush storage and protection device comprising;

an open well having an upstanding wall ending in an upper wall, the upstanding wall being continuous from one side of an opening to another;

a top with an open channel, the open channel extending around the perimeter of the top except at an end of an extension area;

a hinge connecting the open well to the top;

a seal located in the opening;

a first latching mechanism associated with the open well and top opposite the hinge;

and a second latching mechanism associated with the open well and top in the area of the opening, the second latching mechanism comprising a pair of latches disposed on parallel portions of said upstanding wail and open channel, the parallel portions being on separate planes in their length direction with respect to a longitudinal axis of the device and each being located on opposite sides of, and directly adjacent to, said seal;

wherein a paint brush may be placed within the well and the top may be closed over the well by deflection of the hinge such that the upper wall forms a generally airtight connection with the open channel and the seal closes the opening to secure and protect a paint brush, the first and second latching mechanisms serving to secure the top to the open well.

6. The paint brush storage and protection device as claimed in claim 5, further comprising a magnet.

7. The paint brush storage and protection device as claimed in claim 6, wherein said magnet is positioned on an exterior surface of said paint brush storage and protection device.

8. The paint brush storage and protection device as claimed in claim 5, further comprising at least one projection extending from within said open well generally parallel to said upstanding wall, said projection adapted to engage a paint brush when placed in said open well.

9. The paint brush storage and protection device as claimed in claim 8, wherein said at least one projection is a linear projection.

10. The paint brush storage and protection device as claimed in claim 5, wherein said device is generally translucent.

11. The paint brush storage and protection device as claimed in claim 5, wherein said second latching mechanism comprises a pair of cantilevered tabs extending from said open channel of said top, said pair of tabs each including a hook adapted to engage said upstanding wall upper end when said paint brush storage and protection device is closed.

12. The paint brush storage and protection device as claimed in claim 11, wherein said first latching mechanism comprises a cantilevered tab extending from said open channel of said top, said cantilevered tab including a hook adapted to engage said upstanding wall upper end when said paint brush storage and protection device is closed.

13. The paint brush storage and protection device of claim 12, wherein said seal is open cell foam.

14. A method of protecting and storing a paint brush in a paint brush storage and protection device having a base forming a well; a top; first, second, and third locking mechanisms to secure the top against the base in an airtight manner; and an open stern area with a seal, the second and third locking mechanisms extending along separate planes parallel to each other in their length direction with respect to a longitudinal axis of the device while being directly adjacent to, and on opposite sides of, the seal; said method comprising:

placing a paint brush in the well of the base of the paint brush storage and protection device;

closing the top of the paint brush storage and protection device to enclose at least the bristles of the paint brush;

securing the first locking mechanism;

securing the second locking mechanism;

securing the third locking mechanism;

whereby said steps of closing and securing deform the seal around the stem of the paint brush.

15. The method of protecting and storing a paint brush as claimed in claim 14, wherein the paint brush storage and protection device further comprises a projection on an interior thereof, the method further comprising placing the bristles of the paint brush against the projection.

* * * * *